US009022170B2

(12) United States Patent
Yasoshina

(10) Patent No.: US 9,022,170 B2
(45) Date of Patent: May 5, 2015

(54) MUFFLER EQUIPPED WITH CATALYTIC CONVERTER

(71) Applicant: Honda Motor Co., Ltd., Tokyo (JP)

(72) Inventor: Sayaka Yasoshina, Wako (JP)

(73) Assignee: Honda Motor Co., Ltd., Tokyo (JP)

( * ) Notice: Subject to any disclaimer, the term of this patent is extended or adjusted under 35 U.S.C. 154(b) by 0 days.

(21) Appl. No.: 14/197,502

(22) Filed: Mar. 5, 2014

(65) Prior Publication Data

US 2014/0251718 A1 Sep. 11, 2014

(30) Foreign Application Priority Data

Mar. 11, 2013 (JP) ..... 2013-047813

(51) Int. Cl.

| | |
|---|---|
| ***F01N 3/10*** | (2006.01) |
| ***F01N 1/00*** | (2006.01) |
| ***F01N 1/08*** | (2006.01) |
| ***F01N 1/10*** | (2006.01) |

(52) U.S. Cl.

CPC *F01N 3/10* (2013.01); *F01N 1/003* (2013.01); *F01N 1/083* (2013.01); *F01N 1/089* (2013.01); *F01N 1/10* (2013.01); *F01N 2230/04* (2013.01); *F01N 2470/02* (2013.01); *F01N 2490/08* (2013.01)

(58) Field of Classification Search

CPC ..... F01N 1/003; F01N 1/083; F01N 1/10; F01N 1/089; F01N 3/10; F01N 2490/08; F01N 2230/04; F01N 2470/02

USPC ..... 181/240

See application file for complete search history.

(56) References Cited

U.S. PATENT DOCUMENTS

| | | | | |
|---|---|---|---|---|
| 4,894,987 | A * | 1/1990 | Harwood et al. | 60/299 |
| 5,338,903 | A * | 8/1994 | Winberg | 181/231 |
| 5,548,955 | A * | 8/1996 | Sandefur et al. | 60/299 |
| 5,857,327 | A * | 1/1999 | Sato et al. | 60/302 |
| 5,902,971 | A * | 5/1999 | Sato et al. | 181/262 |
| 6,341,662 | B1 * | 1/2002 | Karlsson | 181/230 |
| 6,393,835 | B1 * | 5/2002 | Stoll et al. | 60/299 |
| 6,789,644 | B2 * | 9/2004 | Mukaida | 181/272 |
| 2009/0293462 | A1 * | 12/2009 | Duch et al. | 60/299 |

FOREIGN PATENT DOCUMENTS

JP 3237333 B2 12/2001

* cited by examiner

*Primary Examiner* — Jeremy Luks

(74) *Attorney, Agent, or Firm* — Westerman, Hattori, Daniels & Adrian, LLP

(57) ABSTRACT

A muffler is capable of stably supporting the catalytic converter in a muffler box with a pair of partitions. The muffler box includes first and second box halves joined together with open surfaces thereof abutting each other, and first and second partition plates interposed between the first and second box halves and overlapping each other to separate inside of the muffler box into first and second silencing chambers and define a third silencing chamber between the first and second partition plates, one end opening of a cylindrical holding tube housing and holding the catalytic converter is connected to the exhaust inlet pipe, the pair of partition plates support the holding tube in such a way as to wrap an outer peripheral surface thereof, and another end opening of the holding tube is communicated with the exhaust outlet pipe through the first, second, and third silencing chambers in this order.

4 Claims, 5 Drawing Sheets

MUFFLER EQUIPPED WITH CATALYTIC CONVERTER

CROSS REFERENCES TO RELATED APPLICATIONS

The present application claims priority under 35 U.S.C. §119 to Japanese Patent Application No. 2013-047813, filed Mar. 11, 2013, entitled "Muffler Equipped with Catalytic Converter". The contents of this application are incorporated herein by reference in their entirety.

TECHNICAL FIELD

The present disclosure relates to an improvement of a muffler equipped with a catalytic converter which includes a muffler box; an exhaust inlet pipe provided to the muffler box and connected to an engine; an exhaust outlet pipe provided to the muffler box and opened to atmosphere; and a catalytic converter disposed in an exhaust path inside the muffler box, the exhaust path communicating between the exhaust inlet pipe and the exhaust outlet pipe.

DESCRIPTION OF THE RELATED ART

Such a muffler equipped with a catalytic converter is known as disclosed in, for example, Japanese Patent No. 3237333.

SUMMARY

This conventional type of muffler equipped with a catalytic converter includes a pair of partitions arranged with a relatively large gap therebetween to support opposite axial end portions of the catalytic converter so as to stably support the catalytic converter inside a muffler box. Arranging these partitions with a large gap therebetween increases a size of the muffler. This increase in the size of the muffler is not preferable because it also increases a likelihood of the muffler interfering with other components, especially in a case of a general-purpose engine mounted on various kinds of work machines.

The present disclosure has been made in view of the above circumstance, and it is preferable to provide a muffler equipped with a catalytic converter capable of stably supporting the catalytic converter in a muffler box with a pair of partitions and also capable of compactly supporting the catalytic converter.

In order to achieve this, according to a first aspect of the present disclosure, there is provided a muffler equipped with a catalytic converter, comprising: a muffler box; an exhaust inlet pipe provided to the muffler box and connected to an engine; an exhaust outlet pipe provided to the muffler box and opened to atmosphere; and a catalytic converter disposed in an exhaust path inside the muffler box, the exhaust path communicating between the exhaust inlet pipe and the exhaust outlet pipe, wherein the muffler box includes first and second box halves joined together with open surfaces thereof abutting each other, and first and second partition plates interposed between the first and second box halves and overlapping each other to thereby separate inside of the muffler box into first and second silencing chambers and define a third silencing chamber between the first and second partition plates, one end opening of a cylindrical holding tube housing and holding the catalytic converter is connected to the exhaust inlet pipe, the pair of partition plates support the holding tube in such a way as to wrap an outer peripheral surface of the holding tube, and another end opening of the holding tube is communicated with the exhaust outlet pipe through the first, second, and third silencing chambers in this order.

According to the first aspect of the present disclosure, the muffler box includes the first and second box halves joined together with the open surfaces thereof abutting each other, and the first and second partition plates interposed between the first and second box halves and overlapping each other to thereby separate the inside of the muffler box into the first and second silencing chambers and define the third silencing chamber between the first and second partition plates, the one end opening of the cylindrical holding tube housing and holding the catalytic converter is connected to the exhaust inlet pipe, the pair of partition plates support the holding tube in such a way as to wrap the outer peripheral surface of the holding tube, and the another end opening of the holding tube is communicated with the exhaust outlet pipe through the first, second, and third silencing chambers in this order. Thus, a gap by which the first and second partition plates are spaced from each other to support the holding tube of the catalyst only needs to be a relatively narrow gap corresponding to a diameter of the holding tube. Accordingly, the muffler equipped with a catalytic converter can be made compact. Moreover, since the pair of partition plates wrap the outer peripheral surface of the holding tube, the holding tube can be supported firmly. Furthermore, since the first and second partition plates can be welded to the holding tube over the entire periphery thereof, exhaust gas is introduced into the catalytic converter without leaking.

In addition, even if ignition occurs in the catalytic converter, its flame is put out while passing through the first, second, and third silencing chambers. Thus, the flame can be prevented from exiting the exhaust outlet pipe to outside.

According to a second aspect of the present disclosure, in addition to the first aspect, the first partition plate is provided with an opening portion for opening the another end opening of the holding tube to the first silencing chamber, at least one of the first and second partition plates is provided with a first silencing hole communicating between the first and second silencing chambers, the second partition plate is provided with a second silencing hole communicating between the second and third silencing chambers, and the exhaust outlet pipe is connected to the third silencing chamber.

According to the second aspect of the present disclosure, the first partition plate is provided with the opening portion for opening the another end opening of the holding tube to the first silencing chamber, at least one of the first and second partition plates is provided with the first silencing hole communicating between the first and second silencing chambers, the second partition plate is provided with the second silencing hole communicating between the second and third silencing chambers, and the exhaust outlet pipe is connected to the third silencing chamber. Accordingly, the flame generated in the catalytic converter can be surely put out while passing through a relatively long exhaust path formed of the opening portion, the first silencing chamber, the first silencing hole, the second silencing chamber, the second silencing hole, and the third silencing chamber.

The above and other objects, characteristics and advantages of the present disclosure will be clear from detailed descriptions of the preferred embodiment which will be provided below while referring to the attached drawings.

DESCRIPTION OF THE PREFERRED EMBODIMENT

An embodiment of the present invention will be described below based on the attached drawings.

Figure 1:
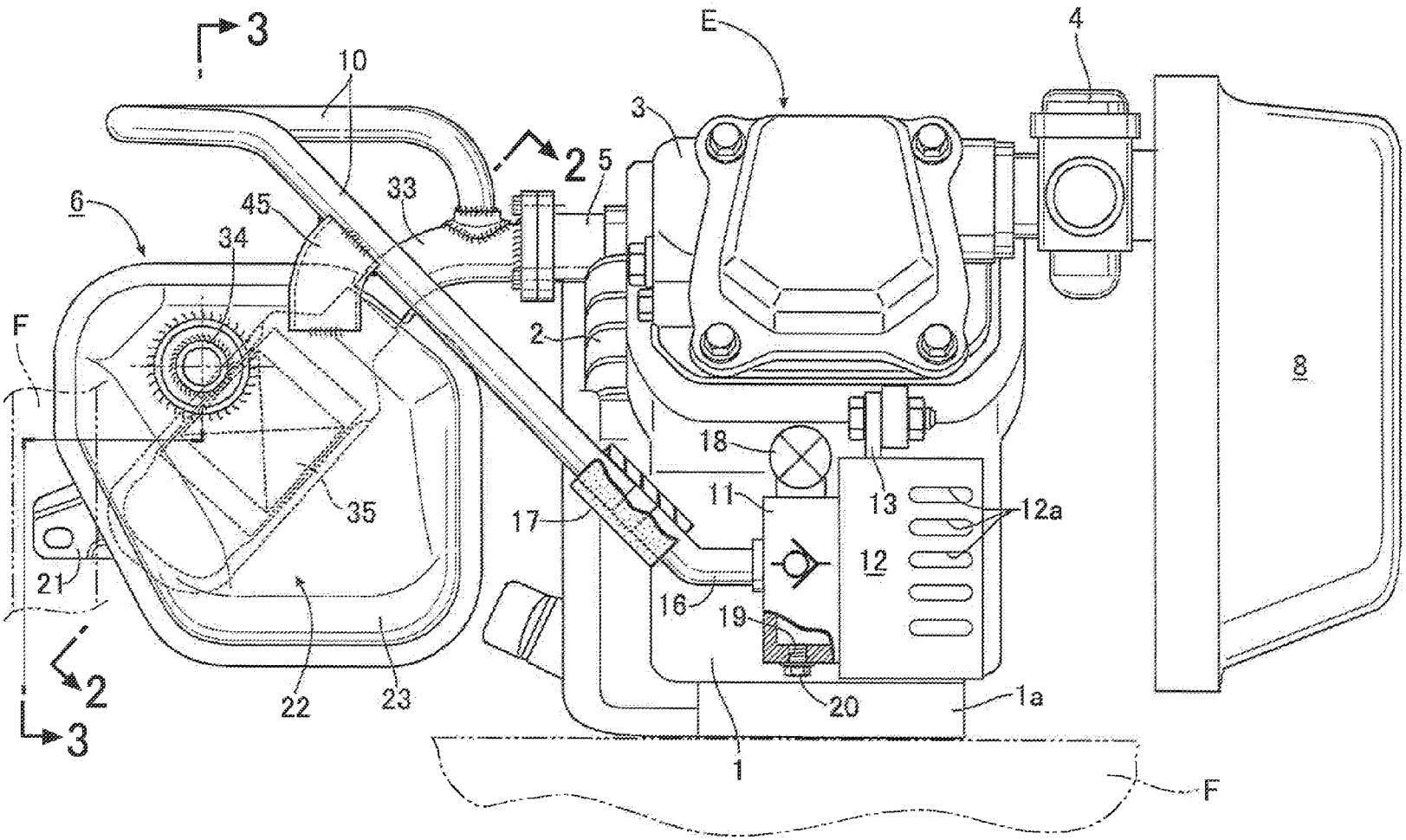
FIG. 1 is a side view of a general-purpose engine according to an embodiment of the present disclosure.

First, referring to FIG. 1, a general-purpose engine E for driving generators and other various work machines includes: a crankcase 1 having a mount flange 1*a* at a lower end thereof; a cylinder block 2 provided continuously on an upper portion of this crankcase 1 and tilting toward one lateral side of the crankcase 1; and a cylinder head 3 provided continuously on an upper end of this cylinder block 2. A carburetor 4 is attached to one side surface of the cylinder head 3 at which an intake port is opened, and an air cleaner 8 which filters intake air into the engine E is connected to an air inlet of this carburetor 4. The mount flange 1*a* mentioned above is attached on a work machine's frame F supporting the engine E.

Moreover, an exhaust inlet pipe 33 of a muffler 6 equipped with a catalytic converter is connected to an exhaust pipe 5 protruding from another side surface of the cylinder head 3. This muffler 6 is disposed at one lateral side of the cylinder block 2.

A downstream end of a secondary-air introducing pipe 10 is connected to one side portion of the exhaust inlet pipe 33 of the muffler 6, and an exclusive air filter 12 is connected to an upstream end of this secondary-air introducing pipe 10 via a one-way valve 11. An intermediate portion of the secondary-air introducing pipe 10 is linked to the muffler 6 via a stay 45.

The air filter 12 is fixed by bolting a bracket 13 thereof to the cylinder block 2 or the cylinder head 3, and is disposed in a space between the crankcase 1 of the engine E and a lower surface of the cylinder block 2 of the engine E. This air filter 12 is configured such that its air inlets 12*a* face in the same direction as an opening direction of an exhaust outlet pipe 34 of the muffler 6.

The one-way valve 11 is formed of a reed valve which responds sensitively to exhaust pulsation, and closes when receiving positive pressure of the exhaust pulsation of the engine E and opens when receiving negative pressure of the exhaust pulsation. This one-way valve 11 is attached to one sidewall of the air filter 12.

The secondary-air introducing pipe 10 is made of copper, and the upstream end of this secondary-air introducing pipe 10 is connected to an outlet pipe 16 of the one-way valve 11 via a rubber tube 17. Since the rubber tube 17 is used as a joint, the secondary-air introducing pipe 10 can be connected to the one-way valve 11 easily. This secondary-air introducing pipe 10 is routed in such a way as to extend from the one-way valve 11 to an upper side of the muffler 6 and then meander and reach the exhaust inlet pipe 33, thereby maximizing a pipe length of the secondary-air introducing pipe 10.

A temperature sensor 18 is provided to the one-way valve 11 or in a vicinity thereof, the temperature sensor 18 configured to detect when ambient temperature reaches or exceeds a predetermined value and stop an operation of the engine E. Moreover, the one-way valve 11 has a drain port 19 for discharging, to an outside, droplets of water resulting from condensation on and running down an inner wall of the secondary-air introducing pipe 10. The drain port 19 is normally closed by a drain bolt 20. Moreover, each section of the meandering secondary-air introducing pipe 10 is disposed laterally or inclined downward so that the droplets of water resulting from condensation on the inner wall do not stay there.

Next, a structure of the muffler 6 will be described with reference to FIGS. 2 to 5.

The muffler 6 is fixed by bolting a bracket 21 to the work machine's frame F, the bracket 21 being welded to a side surface of the muffler 6. A muffler box 22 being a main part of the muffler 6 is formed by swaging and joining four parts which are first and second box halves 23, 24 with their open surfaces abutting each other and first and second partition plates 25, 26 with their outer peripheral end portions overlapping each other, the first and second partition plates 25, 26 being held between the first and second box halves 23, 24. A swaging edge portion 27 used for the swaging and joining is formed in a U-shape in cross section at an outer peripheral end of one of the first and second box halves 23, 24 in such a way as to wrap an outer peripheral end of the other and outer peripheral ends of the first and second partition plates 25, 26. A first silencing chamber 28 is defined between the first box half 23 and the first partition plate 25, a second silencing chamber 29 is defined between the second box half 24 and the second partition plate 26, and further a third silencing chamber 30 is defined between the first and second partition plates 25, 26.

Figure 2:
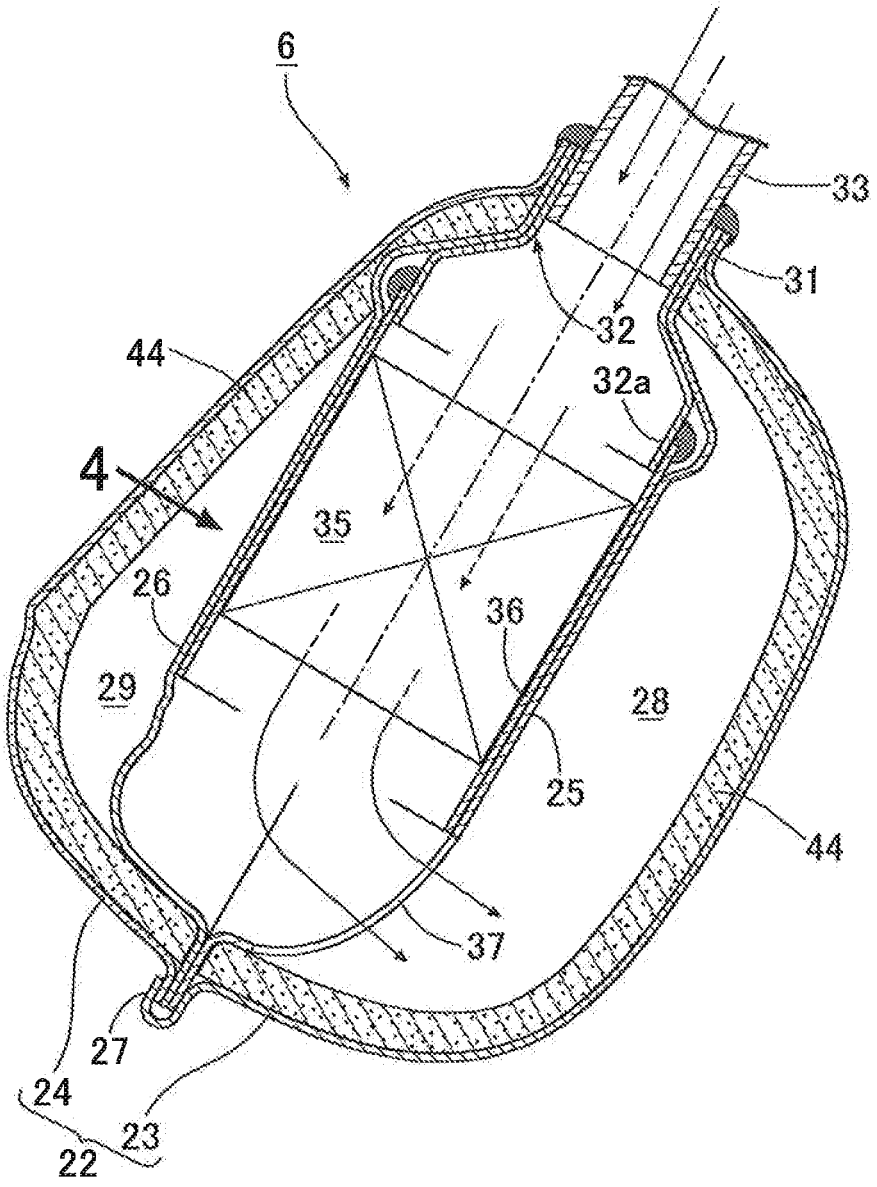
FIG. 2 is an enlarged sectional view taken along a line 2-2 in FIG. 1 and shows a muffler equipped with a catalytic converter.

At one spot in the muffler box 22, the swaging edge portion 27 is cut out and a space between the first and second partition plates 25, 26 is expanded in a pipe shape (see FIG. 2). A connection pipe 32 is inserted and fitted to an inner peripheral surface of a portion 31 thus expanded in the pipe shape, and further the exhaust inlet pipe 33 is inserted and fitted to an inner peripheral surface of the connection pipe 32. These connection pipe 32 and exhaust inlet pipe 33 are welded to the muffler box 22.

The connection pipe 32 has a widening portion 32*a* widening in a funnel shape inside the muffler box 22. One end opening of a cylindrical holding tube 36 housing and holding a catalytic converter 35 is fitted and welded to that widening portion 32*a*. The first and second partition plates 25, 26 support this holding tube 36 such that the first and second partition plates 25, 26 wrap an outer peripheral surface of the holding tube 36 from opposite sides in a radial direction (see FIG. 5). Moreover, the first partition plate 25 is provided with an opening portion 37 for opening another end opening of the holding tube 36 to the first silencing chamber 28 (see FIG. 2).

Moreover, in parts of the first and second partition plates 25, 26 separating the first and second silencing chambers 28, 29, one of the first and second partition plates 25, 26 is provided with an opening 38 (see FIGS. 4 and 5), while the other is provided with many first silencing holes 39 communicating between the first and second silencing chambers 28, 29 through the opening 38.

Figure 3:
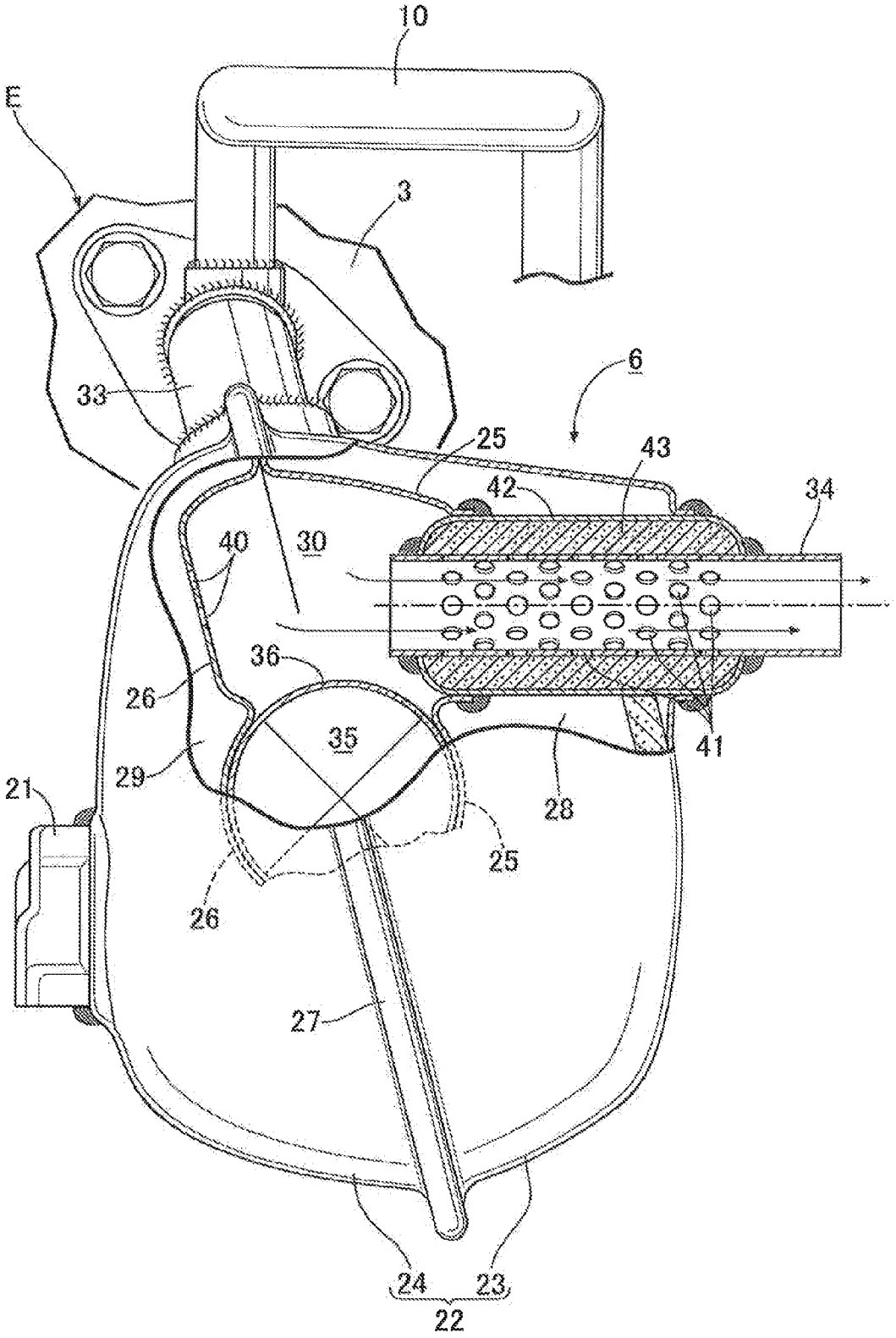
FIG. 3 is an enlarged sectional view taken along a line 3-3 in FIG. 1 and shows the muffler equipped with a catalytic converter.
Figure 4:
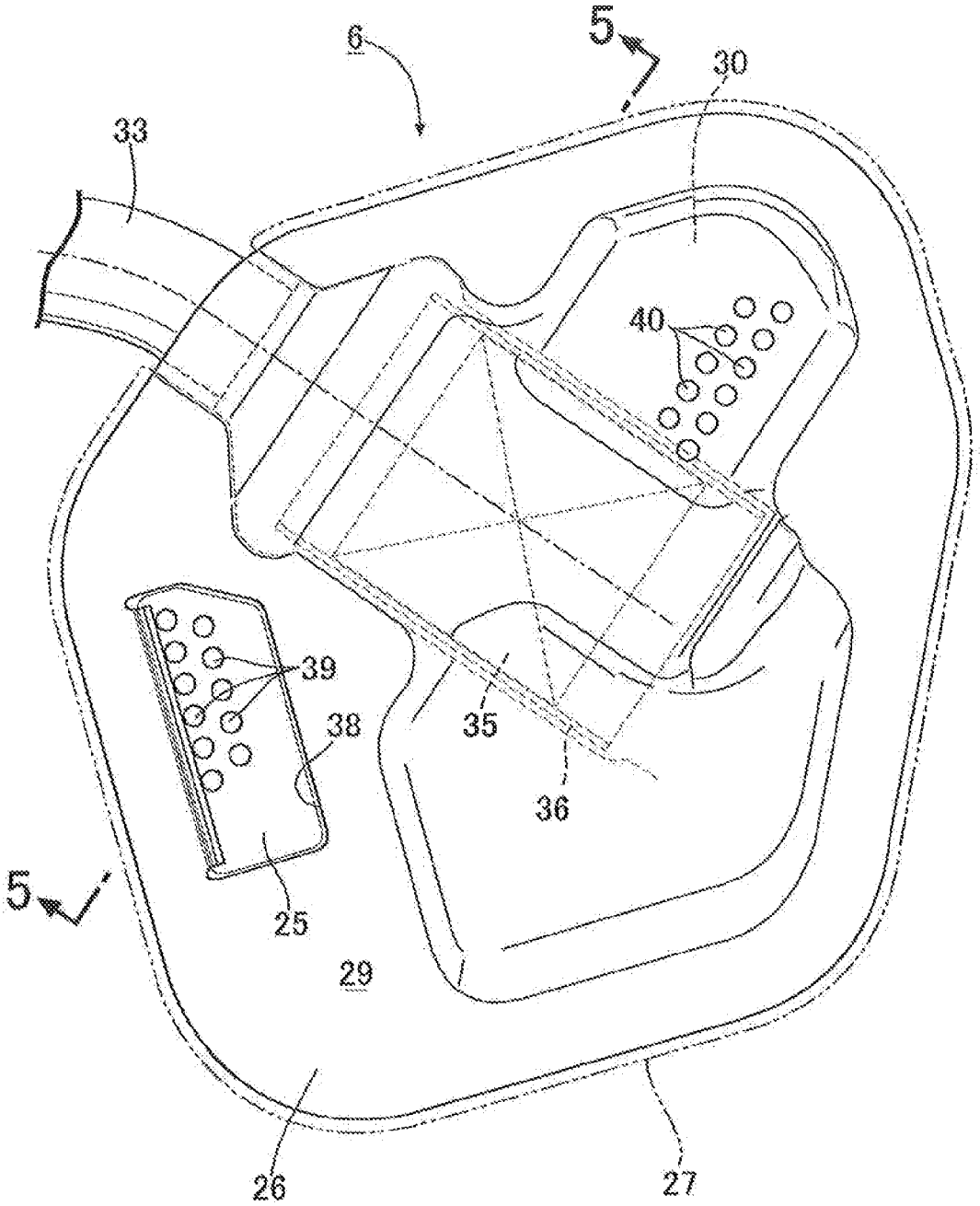
FIG. 4 is a view from an arrow 4 in FIG. 2 and shows a second partition plate.
Figure 5:
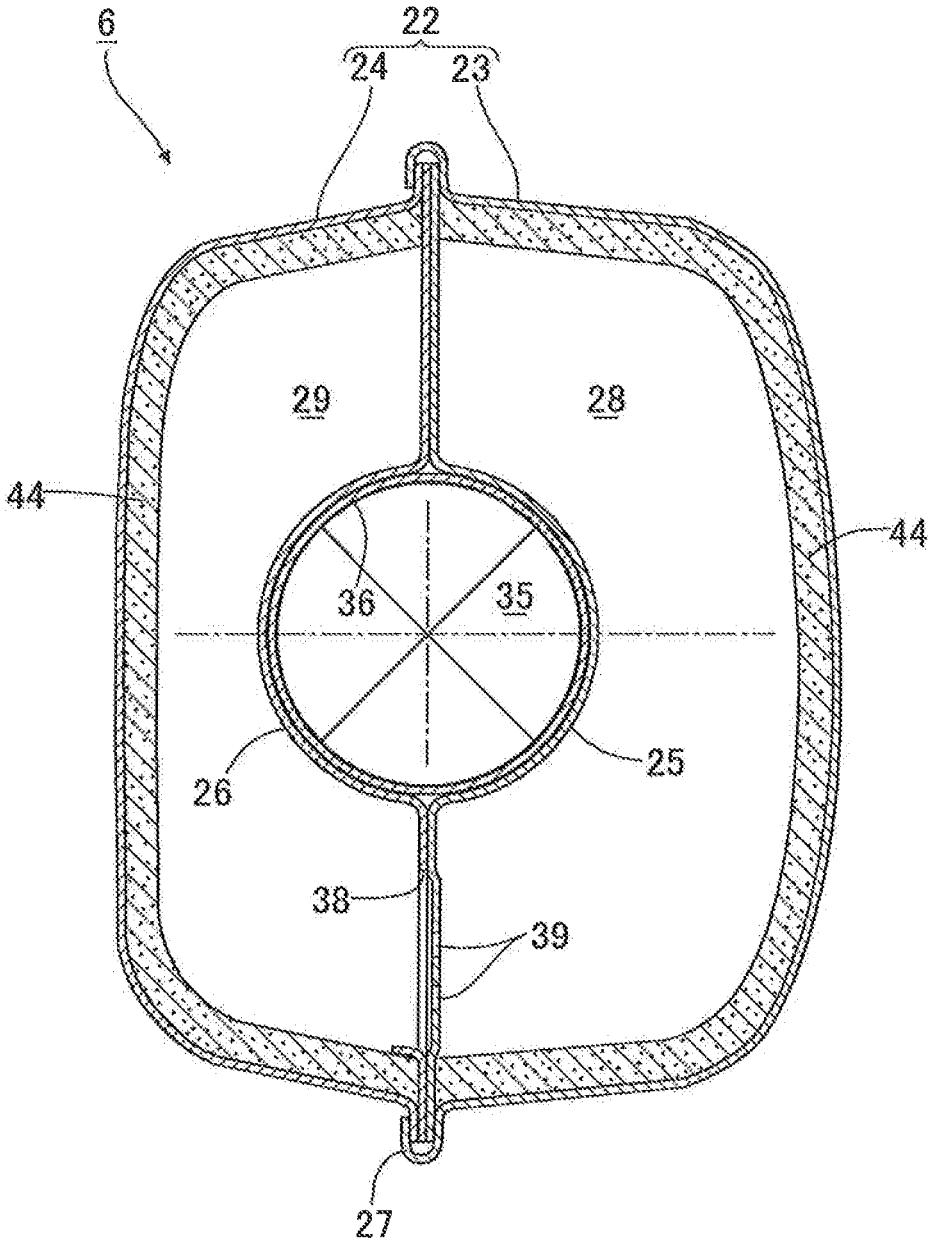
FIG. 5 is a sectional view taken along a line 5-5 in FIG. 4.

Further, the second partition plate 26 is provided with many second silencing holes 40 communicating between the second and third silencing chambers 29, 30 (see FIG. 3).

The third silencing chamber 30 is opened to atmosphere through the exhaust outlet pipe 34. The exhaust outlet pipe 34 is supported by an outlet-pipe outer tube 42 laid between and welded to the first partition plate 25 and the first box half 23. The exhaust outlet pipe 34 is provided with many third silencing holes 41 opened toward an inside of the outlet-pipe outer tube 42. An inside of the outlet-pipe outer tube 42 is filled with a sound absorbing material 43 such as glass wool or the like facing the third silencing holes 41.

A heat insulating and sound absorbing material 44 is adhered to an inner surface of the muffler box 22, the heat insulating and sound absorbing material 44 facing the first and second silencing chambers 28, 29, respectively.

Next, operations of this embodiment will be described.

When the engine E is in operation, exhaust gas discharged from the exhaust pipe 5 into the exhaust inlet pipe 33 passes through an inside of the muffler 6 as follows. Specifically, the exhaust gas passes through the connection pipe 32, the catalytic converter 35, the opening portion 37, the first silencing chamber 28, the first silencing holes 39, the second silencing chamber 29, the second silencing holes 40, the third silencing chamber 30, and the exhaust outlet pipe 34 with the third silencing holes 41 in this order to thereby reduce noise, and is then discharged to the atmosphere. In the meantime, in the catalytic converter 35, HC and $CO_2$ in the exhaust gas are purified through oxidative reaction and NOx in the exhaust gas is purified through reductive reaction. In order to facilitate these purifying reactions, the exhaust pulsation of the engine E is utilized to supply secondary air into the exhaust gas as follows.

When the positive pressure of the exhaust pulsation that occurs inside the exhaust inlet pipe 33 in an exhaust stroke of the engine E is transmitted through the secondary-air introducing pipe 10 to the one-way valve 11, the one-way valve 11 closes, thereby preventing transmission of the positive pressure to the air filter 12 side. Then, when the negative pressure of the exhaust pulsation is transmitted through the secondary-air introducing pipe 10 to the one-way valve 11, the one-way valve 11 opens, thereby transmitting the negative pressure to the air filter 12. As a result, atmospheric air is drawn into and filtered by the air filter 12, sucked into the exhaust inlet pipe 33 through the one-way valve 11 and the secondary-air introducing pipe 10, well mixed with the exhaust gas inside the exhaust inlet pipe 33, and then supplied to the catalytic converter 35. In this way, the aforementioned purifying reactions can be facilitated effectively.

Here, the secondary air to be mixed with the exhaust gas is filtered by the exclusive air filter 12 independent of the air cleaner 8 of the engine E. In this way, intake pulsation and the exhaust pulsation of the engine E are prevented from interfering with each other, thereby making it possible to exhibit sufficient output performance utilizing the intake pulsation of the engine E and its inertial effect, and also to reliably perform supply of the secondary air to the exhaust gas utilizing the exhaust pulsation.

Moreover, the air filter 12 is disposed between the crankcase 1 of the engine E and the lower surface of the cylinder block 2 of the engine E. Thus, the space between the crankcase 1 of the engine E and the lower surface of the cylinder block 2 of the engine E, which is originally a dead space, can be utilized effectively for installation of the air filter 12. Accordingly, it is possible to suppress increase in an outer size of the whole engine E caused by the installation.

Furthermore, there is a relatively long distance between the one-way valve 11, which is provided to the air filter 12 disposed below the cylinder block 2, and the exhaust inlet pipe 33 connected to the cylinder head 3, and the secondary-air introducing pipe 10 connecting the one-way valve 11 and the exhaust inlet pipe 33 is routed in such a way as to meander above the muffler 6. Thus, an entire length of the secondary-air introducing pipe 10 can surely be long enough. In this way, intake inertia of the secondary air by the negative pressure is utilized effectively, thereby making it possible to reliably perform the supply of the secondary air into the exhaust gas. Accordingly, the purifying reactions in the catalytic converter 35 can be performed more effectively.

Even if the one-way valve 11 experiences a failure and remains opened, hence allowing the exhaust gas to enter the air filter 12 side through the secondary-air introducing pipe 10 and be discharged to the atmosphere through the air inlets 12*a* in the air filter 12, the exhaust gas discharged through the air inlets 12*a* does not touch any object since the air inlets 12*a* face in the same direction as the exhaust outlet in the exhaust outlet pipe 34 of the muffler 6, and usually no object is disposed in such a way as to face and block the exhaust outlet in the muffler 6.

Moreover, when the exhaust gas enters the one-way valve 11 side and excessively heats the one-way valve 11 to or above a predetermined temperature, the temperature sensor 18 installed on the one-way valve 11 or in the vicinity thereof is actuated to stop the operation of the engine E. Accordingly, failures of peripheral components due to the excessive heating can be prevented.

After the operation of the engine E is stopped, condensation occurs on the inner wall of the secondary-air introducing pipe 10 and droplets of water formed by the condensation run down to and accumulate on the one-way valve 11. In this case, the drain port 19 may be opened, so that the water can be released to the outside.

In the muffler 6 equipped with the catalytic converter 35, the muffler box 22 includes the first and second box halves 23, 24 joined together with their open surfaces abutting each other, and the first and second partition plates 25, 26 interposed between these first and second box halves 23, 24 and overlapping each other to thereby separate the inside of the muffler box 22 into the first and second silencing chambers 28, 29 and define the third silencing chamber 30 between the first and second partition plates 25, 26. The one end opening of the cylindrical holding tube 36 housing and holding the catalytic converter 35 is connected to the exhaust inlet pipe 33. The pair of partition plates 25, 26 support the holding tube 36 in such a way as to wrap the outer peripheral surface of the holding tube 36. The another end opening of the holding tube 36 is communicated with the exhaust outlet pipe 34 through the first, second, and third silencing chambers 28 to 30 in this order. Thus, a gap by which the first and second partition plates 25, 26 are spaced from each other to support the holding tube 36 of the catalytic converter 35 only needs to be a relatively narrow gap corresponding to a diameter of the holding tube 36. Accordingly, the muffler 6 equipped with a catalytic converter can be made compact. Moreover, since the pair of partition plates 25, 26 wrap the outer peripheral surface of the holding tube 36, the holding tube 36 can be supported firmly. Furthermore, since the first and second partition plates 25, 26 can be welded to the holding tube 36 over an entire periphery of the holding tube 36, the exhaust gas is introduced into the catalytic converter 35 without leaking.

In addition, even if ignition occurs in the catalytic converter 35, its flame is put out while passing through the first, second, and third silencing chambers 28 to 30, and never exits the exhaust outlet pipe 34 to the outside.

Specifically, the first partition plate 25 is provided with the opening portion 37 for opening the another end opening of the holding tube 36 to the first silencing chamber 28. At least one of the first and second partition plates 25, 26 is provided with the first silencing holes 39 communicating between the first and second silencing chambers 28, 29. Moreover, the second partition plate 26 is provided with the second silencing holes 40 communicating between the second and third silencing chambers 29, 30. Also, the exhaust outlet pipe 34 is connected to the third silencing chamber 30. Accordingly, the flame generated in the catalytic converter 35 can be surely put out while passing through a relatively long exhaust path formed of the opening portion 37, the first silencing chamber 28, the first silencing holes 39, the second silencing chamber 29, the second silencing holes 40, and the third silencing chamber 30.

Note that the present invention is not limited to the above-described embodiment, and various design changes can be made without departing from the gist of the present invention.

What is claimed is:

1. A muffler equipped with a catalytic converter, comprising:

a muffler box;

an exhaust inlet pipe provided to the muffler box and connected to an engine;

an exhaust outlet pipe provided to the muffler box and opened to atmosphere;

a catalytic converter disposed in an exhaust path inside the muffler box, the exhaust path communicating between the exhaust inlet pipe and the exhaust outlet pipe; and a cylindrical holding tube disposed in the muffler box, the cylindrical holding tube housing and holding the catalytic converter, wherein the muffler box includes first and second box halves joined together with open surfaces thereof abutting each other, and first and second partition plates interposed between the first and second box halves and overlapping each other to separate inside of the muffler box into first and second silencing chambers and define a third silencing chamber between the first and second partition plates, one end opening of the cylindrical holding tube is connected to the exhaust inlet pipe, the pair of partition plates support the holding tube in such a way as to wrap an outer peripheral surface of the holding tube, and the other end opening of the holding tube is communicated with the exhaust outlet pipe through the first, second, and third silencing chambers in this order, wherein the first and second partition plates include a gap therebetween, the cylindrical holding tube is disposed in the gap, and the third silencing chamber is a part of the gap.

2. The muffler with a catalytic converter according to claim 1, wherein the first partition plate is provided with an opening portion for opening the other end opening of the holding tube to the first silencing chamber, at least one of the first and second partition plates is provided with a first silencing hole communicating between the first and second silencing chambers, the second partition plate is provided with a second silencing hole communicating between the second and third silencing chambers, and the exhaust outlet pipe is connected to the third silencing chamber.

3. The muffler with a catalytic converter according to claim 1, wherein the third silencing chamber is disposed on a side wall of the cylindrical holding tube such that the third silencing chamber is defined by the first and second partition plates and the side wall of the cylindrical holding tube.

4. The muffler with a catalytic converter according to claim 3, wherein the first and second partition plates define sides of the third silencing chamber and the side wall of the cylindrical holding tube defines a bottom of the third silencing chamber.

* * * * *